US005318177A

United States Patent [19]

Isacson

[11] Patent Number: 5,318,177

[45] Date of Patent: Jun. 7, 1994

[54] MULTI-FUNCTION CONTAINER WITH A LIGHT SOURCE

[76] Inventor: Bruce P. Isacson, 4533 Gentry Ave., Studio City, Calif. 91607

[21] Appl. No.: 100,505

[22] Filed: Jul. 30, 1993

[51] Int. Cl.[5] ..... A61J 1/00; B65D 85/58; F21V 33/00

[52] U.S. Cl. ..... 206/38.1; 206/0.81; 206/540; 362/116; 362/154; 362/253; 368/10

[58] Field of Search ..... 206/38, 38.1, 39.6, 206/528, 534–540, 459.5, 459.1, 0.81; 362/116, 154–156, 202, 253; 368/10

[56] References Cited

U.S. PATENT DOCUMENTS

| | | | |
|---|---|---|---|
| 1,280,300 | 10/1918 | Recker | 362/154 |
| 4,153,927 | 5/1979 | Owens | 362/253 |
| 4,223,801 | 9/1980 | Carlson | 206/534 |
| 4,305,118 | 12/1981 | Paqutte | 362/253 |
| 4,526,474 | 7/1985 | Simon | 206/534 |
| 4,765,459 | 8/1988 | Edwards | 206/38.1 |
| 4,864,474 | 9/1989 | Maglica | 362/116 |
| 4,914,748 | 4/1990 | Schlotter, IV et al. | 362/253 |
| 4,936,444 | 6/1990 | Yamaki | 206/38 |
| 5,008,784 | 4/1991 | Wang | 362/116 |
| 5,086,377 | 2/1992 | Roberts | 362/253 |

*Primary Examiner*—Jimmy G. Foster
*Attorney, Agent, or Firm*—Spensley Horn Jubas & Lubitz

[57] ABSTRACT

A multi-function container includes a housing, a closure and an exterior light source. The container has a first interior portion adapted to hold small items. The closure is used to cover the first interior portion of the housing and to contain the small items in the first interior portion of the housing. The housing also has a second separate interior portion adapted to hold a battery. The light source is operatively coupled to the second interior portion to receive power from the battery, upon the battery being held within the second interior portion. Thus, the multi-function container may serve as a container and/or a flashlight. The multi-function container may also include a key ring which is coupled to an exterior surface of the closure, and may also include a clock coupled to the side of the housing.

5 Claims, 5 Drawing Sheets

MULTI-FUNCTION CONTAINER WITH A LIGHT SOURCE

FIELD OF THE INVENTION

This invention relates to multi-function containers for holding small items and, in particular embodiments, a container for holding medicine tablets or candy and which also has a light source.

BACKGROUND OF THE INVENTION

Traditionally, medicine tablets have been dispensed in small containers, which come in various shapes and sizes. In smaller sizes, which normally contain around 10 tablets, medicine tablet containers can be conveniently carried in purses or pockets. The containers can be cylindrical and have a diameter which is slightly greater than the contained tablets. To seal the containers, many of them use a screw on or friction fit top to allow for safe storage. Moreover, many containers have been designed with childproof caps.

Another common type of medicine tablet container is a small hinged box that hold groups of medicine tablets in layers. This provides the container with a flat profile in one direction that aids in allowing the container to be placed in the purse or pocket. These containers have a single use, to hold medicine tablets. Once the medicine tablets are used up, the container is discarded or refilled with new medicine tablets.

Typically, small medicine tablet containers can be difficult to locate in a purse or a pocket. Moreover, considering the number of articles which may be carried by a typical person in a purse or a jacket (e.g., house and car keys, wallets, coins, tissues, to name just a few), a medicine tablet container can take up pocket or purse space that may be at a premium.

Other articles that may be carried in pockets or purses include small flashlights (often called penlights). However, like medicine tablet containers, these flashlights take up valuable pocket or purse space. Therefore, the space problem is compounded when one must also carry a medicine tablet container and the additional articles as discussed above.

Key rings are another relatively common article that is carried by the typical person to organize keys. Key rings are often attached to a charm or other ornament to enhance their aesthetic appeal, and key rings have been attached to small flashlights, such as penlights.

There are several drawbacks to using these above-described individual articles. Typically, these articles only perform a single function, and this requires the typical person to carry multiple articles to perform multiple functions. Moreover, a typical person must handle several articles, which are typically not designed to work with each other, at the same time in order to perform multiple functions. Additionally, each individual article takes up a portion of the limited space available in a pocket or a purse. Thus, a user must often decide which single-function articles they will take when space is at a premium, and they must also prioritize and decide which functions have to be given up. Therefore, there is a need in the consuming public for a space saving device which has multiple functions.

SUMMARY OF THE DISCLOSURE

It is an object of an embodiment of the present invention to provide an improved multi-function container, which obviates for practical purposes the above-mentioned limitations and fills the needs of the consuming public.

According to an embodiment of the invention, a multi-function container for holding small items and a battery includes a housing with first and second interior portions separated by a barrier, a closure and a light source. The first interior portion is adapted to hold small items, and the second interior portion is adapted to hold the battery. The closure is used to cover the first interior portion of the housing and contain the small items in the first interior portion of the housing. The light source is operatively coupled to the second interior portion to receive power from the battery, upon the battery being held within the second interior portion. Thus, the multi-function container may serve as a container and/or a flashlight. In a preferred embodiment, the multi-function container also includes a key ring which is coupled to an exterior surface of the closure.

In another embodiment of the present invention, the light source has an on-off switch. Moreover, the battery comprises at least one flat, disk-shaped battery. In further embodiments, the light source and battery are adapted to be decoupled from the housing when providing light.

In a further embodiment of the present invention, the housing is cylindrical and has two ends opposite one another, such that the first and second interior portions are at opposite ends of the housing. In this embodiment, the closure is coupled to the housing by frictional contact between the closure and the housing, by threads on the closure and the housing or the like.

In a still further embodiment of the present invention, the housing is rectangular and box-shaped, and the housing has a top and a side. In this embodiment, the first interior portion is located on the side of the housing and the second interior portion is located on the top of the housing. Preferably, the closure is coupled to an edge of the side of the box-shaped housing to cover the first interior portion on the side of the housing.

In particular embodiments of the present invention, the container includes a clock coupled to the side of the housing, and in preferred embodiments, the clock also contains an alarm.

Other features and advantages of the invention will become apparent from the following detailed description, taken in conjunction with the accompanying drawings which illustrate, by way of example, various features of embodiments of the invention.

BRIEF DESCRIPTION OF THE DRAWINGS

A detailed description of embodiments of the invention will be made with reference to the accompanying drawings, wherein like numerals designate corresponding parts in the several figures.

DETAILED DESCRIPTION OF THE PREFERRED EMBODIMENTS

Figure 1:
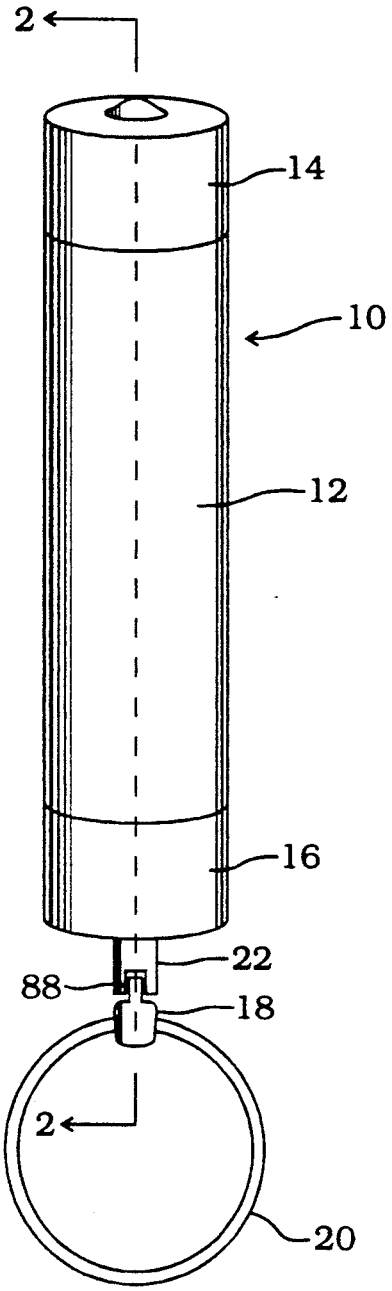
FIG. 1 is a perspective view of a multi-function container with a light source in accordance with a first embodiment of the present invention.

As shown in the drawings for purposes of illustration, the invention is embodied in a multi-function container. In preferred embodiments of the present invention, the multi-function container may hold medicine tablets, and may have a light source and a key ring coupled to the container. However, it will be recognized that further embodiments of the invention may be used to carry other small items, such as candy, coins, money, or other small articles, and the container may be coupled with other articles, such as charms, wallets, clocks, pocket knives or the like to provide additional functions.

The combining of several single function articles into a single multi-function container has several advantages. First, the amount of space required is reduced compared to the space required for a plurality of single function articles, since the multiple functions reside within a single article. This can make the article easier to find, since the user will have to sort through less articles to find the one with the desired function. Second, the multiple functions of the single article cooperate with each other, so as to enhance the usefulness of each individual function and to allow a user to more easily use the multi-function article as compared to a plurality of articles which each perform single functions. For instance, the user can open the container and pour out some tablets, and then readily use the multi-function container to light up the tablets. This allows the user to visually verify the number and kind of tablets removed or remaining in the container. This is quicker and easier than opening a separate container, removing the tablets, putting the container out of the away, finding a flashlight, and then illuminating the tablets. Additionally, a clock may be coupled to the container and used to indicate when to take a tablet. The clock could provide an audible alarm or the time could be viewed with or without illumination from the multi-function container. In another example, the user can hold the multi-function container and use the light to illuminate a darkened lock with a key hole as they insert a key held on the attached key ring. Thus, the user does not have to find a separate flashlight and key ring, or fumble around without a flashlight while trying to insert a key in the dark.

FIG. 1 shows a first embodiment of a multi-function container 10 in accordance with a first embodiment of the present invention. The illustrated multi-function container 10 includes a cylindrical container portion 12, a light source 14, a closure 16, and a key ring support member 18 which is coupled to a key ring 20. The closure cap 16 is attached to a mounting member 22 which is in turn coupled to the key ring support member 18 by a pin 24.

In preferred embodiments, the cylindrical housing 12 is dimensioned so as to carry a limited number of tablets (e.g., ten tablets). This allows the user to carry enough tablets (or candy or other items) for an emergency or limited duration use, while still maintaining a relatively small container size. However, in further embodiments, the housing is dimensioned to hold more or less tablets. Preferably, the housing 12 has a circular cross-section, because this makes the multi-function container easier to grip in one hand and allows the container to hold disk-shaped tablets in a column. However, in other embodiments, the cylindrical housing 12 has other cross-sectional shapes, such as squares, rectangles, triangles, and ovals, to accommodate different tablet sizes and shapes.

The light source 14 is designed to provide an exterior light that can illuminate small areas. Various embodiments of the light source provide wide beams, narrow beams, diffuse beams or a combination of beams which are selectable by the user. Preferably, the light source provides substantially white light; however, in further embodiments the light source provides a colored light. As illustrated, the key ring support 18 is designed to hold a key ring 20 which can support a plurality of keys.

Figure 2A:
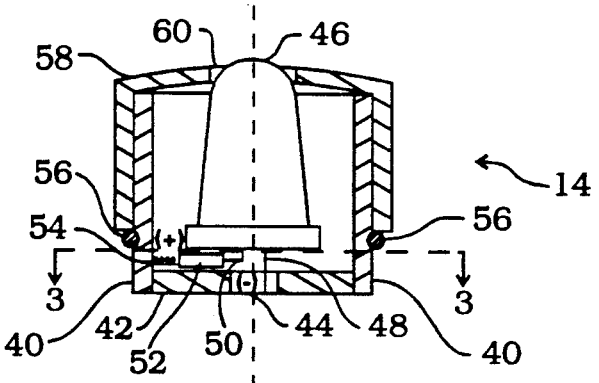
FIGS. 2(*a*)–2(*c*) are cross-sectional views of the first embodiment along the line 2—2 shown in FIG. 1.
Figure 2B:
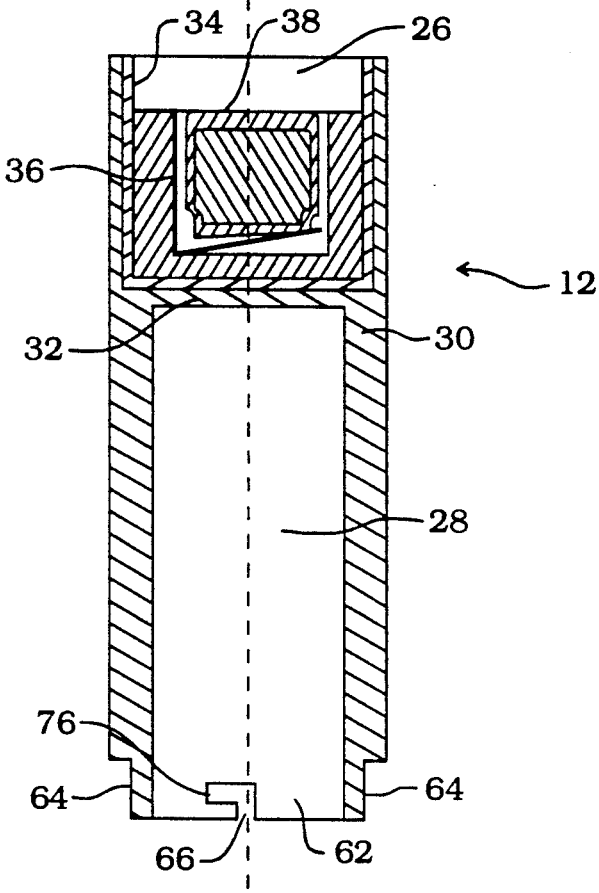
Figure 2C:
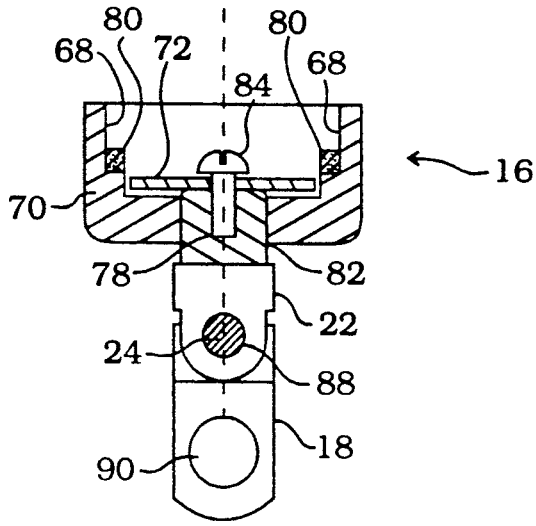
Figure 3:
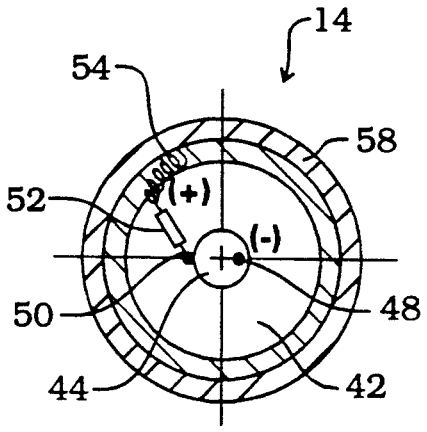
FIG. 3 is a cross-sectional view of the first embodiment along the line 3—3 shown in FIG. 2(*a*).
Figure 4:
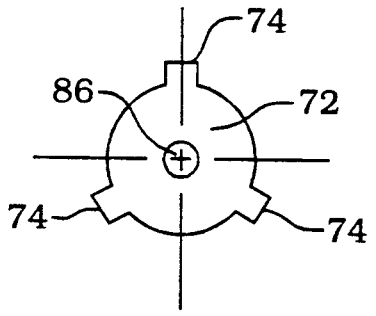
FIG. 4 is a top perspective view of the lock plate shown in FIG. 2(*c*).

FIGS. 2–4 illustrate the construction of the multi-function container 10 in accordance with the first embodiment of the present invention. FIGS. 2(*a*)–2(*c*) show a cross-sectional view of the cylindrical housing portion 12, the light source 14, and the closure 16, as viewed along the line 2—2 in FIG. 1. FIG. 3 shows a cross-sectional view of the light source 14, as viewed along the line 3—3 in FIG. 2(*a*), and FIG. 4 shows a top view of a lock plate used in the closure 16 in FIG. 2(*c*).

The cylindrical housing portion 12, as shown in FIG. 2(*b*), includes a battery housing 26 and a tablet holding portion 28. The battery housing 26 and tablet holding portion 28 are held together by a shell 30, and are separated from each other by an end barrier 32. The shell 30 and end barrier 32 are preferably formed as a single, integral structure, such as by injection molding or other suitable process, for ease of manufacture. However, other embodiments are formed as separate pieces that are secured together by other methods, such as by welding, gluing, or the like. In preferred embodiments, the shell 30 and end barrier 32 are formed from plastic, such as high impact polystyrene, polycarbonate, poly-propylene, ABS plastic, sterile medical plastics or the like. However, other embodiments are formed from metals, such as gold, silver, stainless steel, aluminum or the like; ceramics or a combination of these materials or other suitable materials. In further embodiments, the shell 30 and end barrier 32 are made out of FDA approved materials.

FIG. 2(*b*) shows that the illustrated battery housing 26 includes a female threaded insert 34, a contact strip 36 and a battery 38. FIG. 2(*a*) shows that the light source 14 includes a male threaded insert 40, insulated cover piece 42, a contact pin 44, a lamp 46 with negative contact 48 and positive contact 50, limiting resistor 52, metal spring 54, and 0-ring 56. The female threaded insert 34 of the battery housing 26 couples with the male threaded insert 40 on the light source 14. As the light source 14 is threaded into the female insert 34, the insulated cover piece 42 and the contact pin 44 of the male insert 40 contact a top surface and a positive contact of a battery 38. The contact pin 44 forms an electrical connection between the battery 38 and the negative contact 48 of the lamp 46.

As shown in FIGS. 2(*a*) and 3, the positive contact 50 of the lamp 46 is connected to the current limiting resistor 52 which is connected to a small metal spring 54 that makes electrical contact with the male threaded insert 40. The male threaded insert 40 contacts one end of a contact strip 36 in the battery housing 26, while the other end of the contact strip 36 contacts a negative terminal of the battery 38. To activate the lamp 46 in the illustrated embodiment, the threaded male insert 40 is threaded into insert 34 until electrical contact is made between the male insert 40 and the contact strip 36. To deactivate the lamp 46, the male insert is unscrewed (or unthreaded) slightly to disengage the male insert from the contact strip 36. The seal between the light source 14 and the battery housing 26 is maintained by an O-ring 56, which serves to prevent loosening of the light source 14 and also prevents electrical contact between the male insert 40 and the contact strip 36 until the light source 14 is threaded all the way into the battery housing 26 and activated. In other embodiments, the male insert 40 has at least one protrusion extending from and formed on the surface of the male insert 40 and the female insert 34 has at least two correspondingly shaped notches formed at predetermined spacings around the surface of the female insert 34 to receive the protrusion on the male insert 34 and to hold the light source 14 in the on-state or the off-state.

In preferred embodiments, the metal electrical contacts are made of electrically conductive metal, having minimal corrosive characteristic, such as brass. However, in further embodiments, the metal electrical contacts are made out of other electrical materials, such as copper, aluminum or the like. Moreover, the illustrated battery 38 is a single flat, disk-shaped battery of the type typically used in watches or calculators, which allows the light source 14 to be relatively small. However, in further embodiments, a plurality of flat, disk-shaped batteries or other types of batteries are used. The lamp 46 is preferably an LED (light emitting diode) type light source which has a relatively low energy consumption rate and which provides a focused beam of substantially white light suitable for use as a penlight. However, in further embodiments, colored LEDs or other suitable lamps or illuminating devices are used. Moreover, while the light source 14 in the above-described preferred embodiment is activated by a twisting motion, other embodiments of the light source are activated by other suitable means, such as a multi-position switch, squeeze contacts or the like. In still further embodiments, the light source 14 and battery housing 26 are removable from the shell 30, so that the light source 14 can be operated when decoupled from the multi-function container 10.

The male insert 40 of the light source 14 is held, by welds, adhesives or the like, in an outer shell 58. The outer shell 58 has a diameter which matches the shell 30, and it is made of the same materials as the shell 30 in the cylindrical housing portion 12 to provide a smooth finish and smooth joint between the light source 14 and the cylindrical housing portion 12. However, in other embodiments the outer shell 58 is made of different materials than the shell 30 and does not have a smooth finish. This can increase friction or provide an overall container shape that is easier for the user to hold.

The outer shell 58 has a lamp outlet hole 60 that allows the lamp 46 to emit light from the light source 14. In preferred embodiments, the outlet hole 60 may permit the lamp 46 to extend beyond the shell 58 as shown in FIG. 2(*a*). In other embodiments, the outlet hole 60 holds a lens (not shown) for providing focused light beams. Moreover, in further embodiments, the outlet hole 60 holds filters (not shown) for altering the color of the light source 14.

The tablet holding portion 28 of the cylindrical housing portion 12 is shown as being made of a unitary structural shell 30. However, in other embodiments, the tablet holding portion 28 may contain an additional insert shell (not shown) to provide additional protection or insulation for the tablets. An internal insert may be desirable, for example, if a metal shell 30 and end barrier 32 is used. The insert would minimize the risk of chemical reactions between the metal and the tablets.

The cylindrical housing portion 12, as shown in FIG. 2(*b*), includes an open end 62 which opens into the tablet holding portion 28, a smooth male connecting portion 64, and notches 66. As shown in FIG. 2(*c*), the closure cap 16 includes a smooth female connecting portion 68, and outer shell 70, and a lock plate 72. The open end 62 is capable of being closed by the closure cap 16 as shown in FIGS. 1 and 2. In the illustrated embodiment, the shell 30 is recessed to form the smooth male connecting portion 64 which is formed to couple with the smooth female connecting portion 68 formed in the outer shell 70 of the closure cap 16. The locking notches 66 of the tablet holding portion 28 are used with the lock plate 72 to hold the closure cap 16 securely and seal the open end 62 of the tablet holding portion 28. As shown in FIG. 4, the lock plate 72 has teeth 74 which engage locking portions 76 of the notches 66 to lock the closure cap 16 in position.

The closed end of the outer shell 70 of the closure cap 16 includes a passage 78 to allow the mounting member 22 to pass through the closure cap 16, and a gasket 80. The mounting member 22 includes a threaded screw hole 82. The mounting member 22 is secured to the closure cap 16 through the passage 78 by a screw 84 passing through a hole 86 in the lock plate 72 and threaded into the threaded screw hole 82. To secure the closure cap 16 to the tablet holding portion 28, the closure cap 16 is placed over the open end 62 and male connecting member 64, and pressed against the outer shell 30 of the cylindrical housing portion 12. The mounting member 22 is then rotated to cause the teeth 74 of the lock plate 72 to engage the notches 66. Next, the closure cap 16 is pressed firmly against the shell 30 to compress the gasket 80 made of sponge, rubber, plastic or the like, attached to the closure cap 16. Compression of the gasket 80 forms a seal and allows the teeth 74 of the lock plate 72 to lock into the locking portions 76 of the notches 66. Because the closure cap 16 requires the mounting member 22 to be rotated to engage the notches 66, the illustrated closure cap 16 reduces the risk of accidental or unintended opening of the multi-function container 10.

In further embodiments, other well known closure devices (such as those purported by others to be "child resistant") are used. Moreover, in still further embodiments, other closure cap securing methods, such as threads, friction fits, snap fits or the like, are used to secure the closure cap 16 to the cylindrical housing portion 12 to accommodate easy open and closing. Preferably, the outer shell 70 of the closure cap 16 matches the diameter of the shell 30 and is made of the same material as the shell 30 in the cylindrical housing portion 12 to provide a smooth finish and joint between the closure cap 16 and the cylindrical housing portion 12. However, in other embodiments, the outer shell 70 is made of different materials than the shell 30 and does not have a smooth finish. This can increase friction or provide an overall container shape that is easier for the user to hold.

Preferably, the mounting member 22 of the closure cap 16 is coupled to the key ring support member 18 by a pin 20 passing though pin holes 88 in the mounting member 22 and key ring support member 18. However, in further embodiments, the key ring support member 18 is scoured to the mounting member 22 by other suitable means, such as nuts and bolts, rivets, cotter pins or the like. The key ring support member 18 also has a key ring hole 90 which is used to support and secure a key ring 20. However, in other embodiments, the key ring hole 90 is not limited to receiving key rings; it also or alternatively receives stretch bands, necklaces, bracelets, or other devices.

In other embodiments, the cylindrical housing portion 12 is formed with one or more pockets on the exterior surface of the shell 30. The one or more pockets are shaped to hold small items or articles, such as toothpicks, tweezers, scissors or the like. In alternative embodiments, the cylindrical housing portion is formed with one or more grooves or slots on the exterior surface of the shell 30. The one or more grooves or slots may be coupled to small articles, such as toothpicks, tweezers, scissors or the like. In further embodiments, the closure cap 16 has a spoon, fork, tweezers or the like coupled to the inside of the closure cap 16 to allow the user to handle the small items contained in the multi-function container 10.

In preferred embodiments of the present invention, the overall length of the multi-function container 10 is preferably less than or equal to 3.0 inches and the overall diameter is preferably less than or equal to 0.75 inches. These dimensions allow the container 10 to be readily portable and readily carried in a user's pocket, purse, glove compartment, children's school bag, around a user's neck as a necklace or the like. However, further embodiments are larger or smaller.

In use, the user can quickly locate the multi-function container 10 in a pocket or purse, because a single article is typically easier to locate than a plurality of single function items. Preferably, the user holds the multi-function container 10 in one hand, and uses the other hand to activate or use one or more functions of the container 10. For example, the user may hold the multi-function container in one hand, while using the other hand to remove the closure cap 16 and hold tablets poured from the tablet holding portion 28. With the thumb and/or fingers of the one hand holding the container 10, the may then twist and activate the light source 14 to illuminate the tablets held in the other hand, e.g., to verify the number and type of tablets poured out of the container 10. Moreover, the light source can be used to illuminate instructions on how to use the tablets or read other material in darkened areas. Furthermore, if the light source 14 is removable, the light source 14 can be used to illuminate the tablets still contained inside the tablet holding portion 28. Thus, the light source 14 and the tablet holding portion 28, together in a single, easy-to-hold housing, cooperate with each other to enhance their individual usefulness.

In another example, the user can illuminate a darkened lock and key hole by twisting, activating and aiming the light source 14 at the lock, while placing the key in the lock. For example, if the key ring 20 is coupled to the key ring support member 18 by a stretch band or cord, the key ring and keys may be easily bent around and placed in the key hole which is illuminated by the light source 14. In some cases, it may be easier to remove either the light source 14 or the closure cap 16 and attached key ring 20. Also, the light source 14 can be used as a safety light to indicate a user's presence as they walk through dark areas to a car, building or the like.

Figure 5:
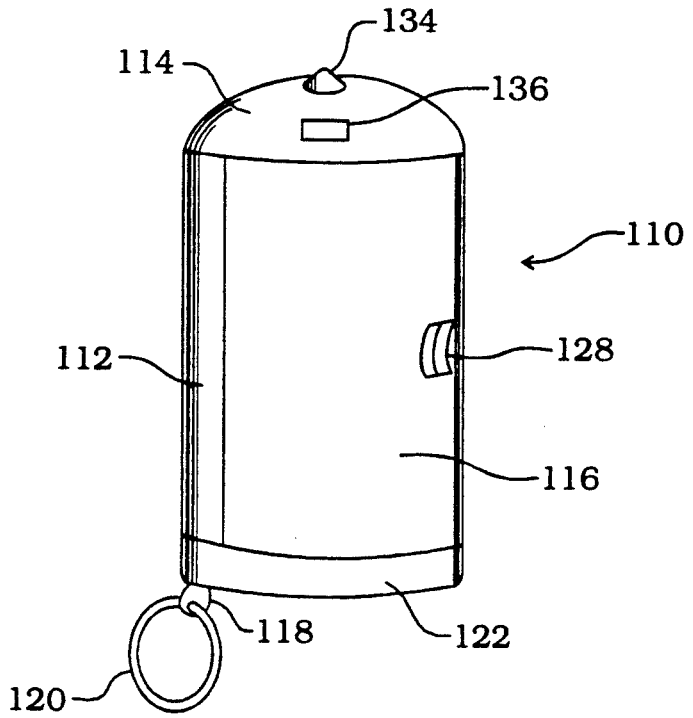
FIG. 5 is a perspective view of a multi-function container with a light source in accordance with a second embodiment of the present invention.
Figure 6:
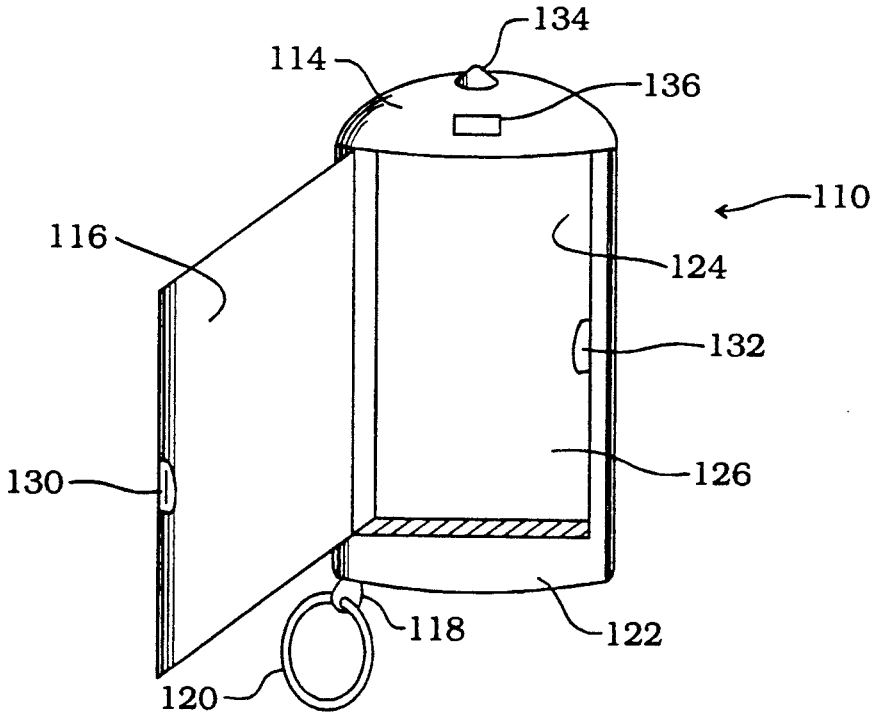
FIG. 6 is a perspective view of the second embodiment shown in FIG. 5 in an open condition.

FIGS. 5 and 6 illustrate a multi-function container 110 in accordance with a second embodiment of the present invention. The multi-function container 110 includes a rectangular, box-shaped housing portion 112, a light source 114, a closure panel 116 and a key ring support member 118. The key ring support member 118 is coupled to a key ring 120 and a mounting portion 122 of the box-shaped housing portion 112.

In the FIGS. 5 and 6 embodiment, the closure panel 116 covers and seals an opening 124 into a tablet holding compartment 126 in the box-shaped housing portion 112. Preferably, the closure panel 116 is connected by hinges along an edge of the opening 124, and opens and closes like a book. In another embodiment, the closure panel 116 is formed as an integral part of the boxed-shaped housing portion 112, and bends along a crease formed between the panel 116 and housing portion 112. However, in further embodiments, other closure methods, such as sliding panels, friction fit panels or the like, are used.

To aid in opening the closure panel 116, the outer surface of the panel 116 preferably has finger grooves 128. In preferred embodiments, the closure panel 116 is held in the closed position by friction between matched lock tabs 130 and 132. To open the multi-function container 110, the user engages a fingernail or the like in the finger grooves 128 and applies sufficient force to overcome the restraining force applied by the lock tab 132 on the matched lock tab 130. To close and secure the closure panel 116, the user presses down on the closure panel 116 until the lock tab 132 engages and seats in the matched lock tab 130. In other embodiments, other locking methods are used, such as spring-loaded catches, snap fittings, frictional contacts, pins or the like.

The tablet holding compartment 126 in the rectangular, box-shaped housing portion 112 allows the multi-function container 110 to more easily hold a variety of different shaped tablets, either separately or in combination. In further embodiments, a plurality of sub-compartments are placed inside the tablet holding compartment 126 to allow segregation and organization of a plurality of different tablet sizes or types that are held together at the same time.

In the second embodiment, a lamp 134 in the light source 114 is activated by a light switch 136. The lamp 134 may remain in an on state as long as the light switch 136 is continuously depressed. This saves power consumption, since the lamp 134 only remains on while the light switch is depressed. In an alternative embodiment, the light source 114 does not have a visible light switch 136, rather electrical contacts are contained between layers in the light source 114 and/or the box-shaped housing portion 112 and is activated by squeezing the multi-function container 110 between a user's fingers to cause the electrical contacts to close the circuit. However, in further embodiments, a multiple position light switch 136 is used, where the on-state or off-state of the lamp 134 is determined by the position of the light switch 136 and not by Whether the light switch 136 is continually depressed.

In other embodiments, the multi-function container 110 is made out of the same materials or incorporates any of the alternative features which were previously described above with the multi-function container 10. The illustrated multi-function container 110 is shown with an attached key ring 120; however, articles other than key rings 120 may also be attached. This embodiment, like the previously described embodiment, holds medicine tablets, candy or other small items.

Figure 7:
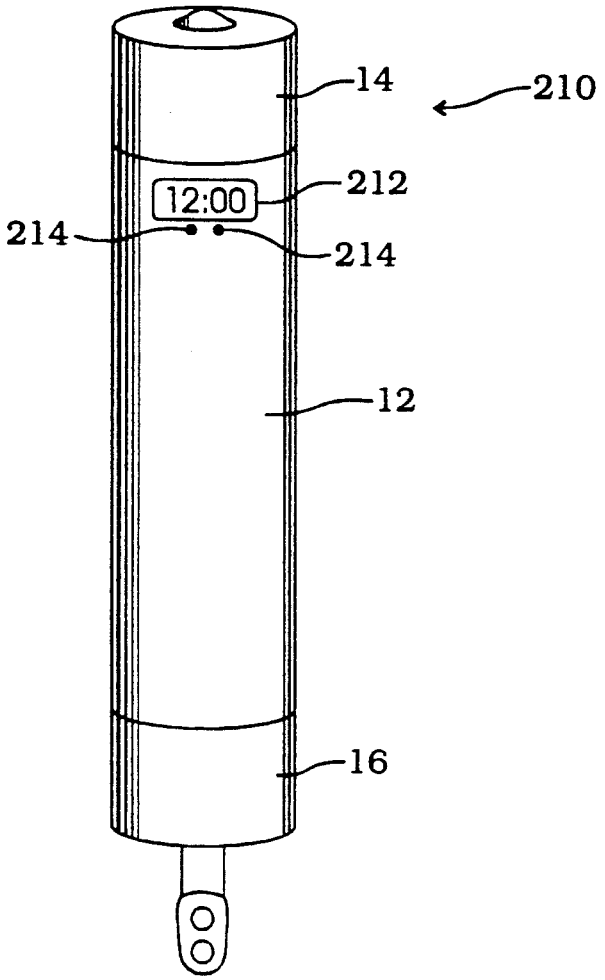
FIG. 7 is a perspective view of a multi-function container with a light source in accordance with a third embodiment of the present invention.

FIG. 7 shows a multi-function container 210 in accordance with a third embodiment of the present invention, which includes a clock 212 mounted on the side of the cylindrical housing portion 12. Preferably, the clock 212 is mounted close to the power source for the light source 14, such that power for the clock 212 is shared with the light source 14. However, in alternative embodiments, the clock 212 has its own power source.

In preferred embodiments, the clock 212 uses an LCD (liquid crystal display) to display the current time and date, and has a plurality of clock setting buttons 214. In alternative embodiments, the clock 212 display uses LEDs, fluorescent characters, analog hands or the like, dependent on the use of the container 210. The clock 212 is set by the plurality of clock setting buttons 214 in a manner similar to that used to set time on an LCD watch. However, in alternative embodiments, other methods of setting the time, such as knobs or the like are used. Preferred functions that are provided by the clock 212 are time, a.m. or p.m. indications, seconds, date, stopwatch functions and alarm functions. However, other embodiments have more or less clock functions. Moreover, the use of the clock 212 may be used with any of the previously described embodiments.

The inclusion of a clock 212 has several advantages. It allows the multi-function container 210 to have an additional function and further reduce the number of individual items a user must carry. The clock 212 can replace the need for a separate time piece or alarm. In addition, the function of the clock cooperates with other functions of the container, so as to enhance the usefulness of such other functions. For instance, an alarm can be used to indicate when to take tablets held in the container 210.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A multi-function container for holding small items and a battery, comprising:

a housing with a first interior portion and a second interior portion separated by a barrier, the first interior portion adapted to hold the small items and the second interior portion adapted to hold the battery;

a closure to cover the first interior portion of the housing to contain the small items in the first interior portion of the housing;

a light source operatively coupled to the second interior portion to receive power from the battery; upon the battery being held within the second interior portion;

a key ring support coupled to the closure; and a clock, and wherein the housing has a side and the clock is coupled to the side of the housing.

2. A multi-function container for holding small objects and at least one battery, the container comprising:

a cylindrical housing having a first interior portion adapted for holding small objects, a closed end and a opening leading to the first interior portion of the cylindrical housing and which is opposite to the closed end, and a second interior portion, separated from the first interior portion by the closed end, adapted for holding the at least one battery;

a closure cap having an exterior surface, the closure cap adapted to be coupled to the opening of the cylindrical container to close off and seal the first interior portion of the cylindrical housing;

an exterior light source operatively coupled to the second interior portion to receive power from the at least one battery, upon the at least one battery being held within the second interior portion; and a key ring support coupled to the exterior surface of the closure cap.

3. A multi-function container according to claim 2, wherein the light source and the at least one battery are adapted to be decoupled from the housing when providing light.

4. A multi-function container according to claim 3, wherein the at least one battery comprises at least one flat, disk-shaped battery.

5. A multi-function container according to claim 3, further comprising a clock, and wherein the cylindrical housing has a side and the clock is coupled to the side of the housing.

* * * * *